US008013531B2

(12) United States Patent
Morioka et al.

(10) Patent No.: US 8,013,531 B2
(45) Date of Patent: Sep. 6, 2011

(54) PLASMA DISPLAY PANEL HAVING A PLURALITY OF LAYERS CONTAINING CALCIUM OXIDE AND BARIUM OXIDE

(75) Inventors: Kazuhiro Morioka, Kyoto (JP); Yui Saitou, Osaka (JP); Akira Kawase, Hyogo (JP); Shinsuke Yoshida, Hyogo (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 248 days.

(21) Appl. No.: 12/442,454

(22) PCT Filed: Nov. 19, 2008

(86) PCT No.: PCT/JP2008/003378

§ 371 (c)(1),
(2), (4) Date: Mar. 23, 2009

(87) PCT Pub. No.: WO2009/066449

PCT Pub. Date: May 28, 2009

(65) Prior Publication Data

US 2010/0133984 A1 Jun. 3, 2010

(30) Foreign Application Priority Data

Nov. 21, 2007 (JP) ..... 2007-301491

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS

| | | | | |
|---|---|---|---|---|
| 5,977,708 | A | 11/1999 | Amatsu et al. | |
| 7,208,430 | B2 | 4/2007 | Hasegawa et al. | |
| 2001/0026255 | A1 | 10/2001 | Sano et al. | |
| 2005/0179117 | A1 | 8/2005 | Lee | |
| 2005/0231118 | A1 | 10/2005 | Fujimine et al. | |
| 2006/0276322 | A1* | 12/2006 | Hasegawa et al. | 501/49 |
| 2007/0052361 | A1 | 3/2007 | Hasegawa et al. | |
| 2007/0172672 | A1 | 7/2007 | Miyazaki et al. | |
| 2007/0216306 | A1 | 9/2007 | Kim | |

FOREIGN PATENT DOCUMENTS

| | | | |
|---|---|---|---|
| CN | 1572744 | A | 2/2005 |
| CN | 1789190 | A | 6/2006 |
| CN | 1953942 | A | 4/2007 |

(Continued)

OTHER PUBLICATIONS

Japanese Language International Search Report for PCT/JP2008/003378 dated Dec. 22, 2008.

(Continued)

*Primary Examiner* — Joseph L Williams
(74) *Attorney, Agent, or Firm* — RatnerPrestia

(57) ABSTRACT

A plasma display panel is formed of front panel including at least display electrodes, dielectric layer that are formed on glass substrate, and a rear panel including electrodes, barrier ribs, and phosphor layers that are formed on a substrate. Dielectric layer is formed of multiple layers, i.e. lower dielectric layer and upper dielectric layer, and these layers are made of identical material to each other, and the material contains CaO and BaO, and the content of CaO is greater than that of BaO.

5 Claims, 1 Drawing Sheet

FOREIGN PATENT DOCUMENTS

| | | | |
|---|---|---|---|
| EP | 1 816 667 | A1 | 8/2007 |
| JP | 09-050769 | | 2/1997 |
| JP | 09-050769 | A | 2/1997 |
| JP | 2000-313635 | A | 11/2000 |
| JP | 2001-045877 | A | 2/2001 |
| JP | 2001-045877 | A | 2/2001 |
| JP | 2002-053342 | A | 2/2002 |
| JP | 2002-053342 | A | 2/2002 |
| JP | 2003-128430 | A | 5/2003 |
| JP | 2003-128430 | A | 5/2003 |
| JP | 2004-055222 | A | 2/2004 |
| JP | 2004-307329 | A | 11/2004 |
| JP | 2005-041734 | A | 2/2005 |
| JP | 2005-041734 | A | 2/2005 |
| JP | 2005-235735 | A | 9/2005 |
| JP | 2005-314201 | A | 11/2005 |
| JP | 2006-342018 | A | 12/2006 |
| JP | 2007-039269 | A | 2/2007 |
| JP | 2007-126319 | A | 5/2007 |
| JP | 2007-182365 | A | 7/2007 |
| JP | 2007-217271 | A | 8/2007 |
| JP | 2007-299641 | A | 11/2007 |
| JP | 2007-299641 | A | 11/2007 |
| KR | 10-2005-0077391 | A | 8/2005 |
| KR | 10-2007-0051399 | | 5/2007 |
| WO | WO 2006/107051 | A1 | 10/2006 |
| WO | WO 2006/107052 | A1 | 10/2006 |

OTHER PUBLICATIONS

Supplementary European Search Report for Application No. EP 08 82 8889, Apr. 9, 2010, Panasonic Corporation.

South Korea Office Action for Application No. 10-2009-7006112 with English translation, Oct. 19, 2010, Panasonic Corporation.

U.S. Office Action for U.S. Appl. No. 12/442,543, Nov. 10, 2010, Panasonic Corporation.

U.S. Office Action for U.S. Appl. No. 12/442,129, Oct. 28, 2010, Panasonic Corporation.

U.S. Office Action for U.S. Appl. No. 12/442,129, Jan. 19, 2011, Panasonic Corporation.

International Search Report for International Application No. PCT/JP2008/002099, Sep. 2, 2008, Panasonic Corporation.

International Search Report for International Application No. PCT/JP2008/002098, Oct. 28, 2008, Panasonic Corporation.

Supplementary European Search Report for Application No. EP 08 79 0363, Oct. 8, 2010, Panasonic Corporation.

Supplementary European Search Report for Application No. EP 08 79 0362, Oct. 8, 2010, Panasonic Corporation.

Chinese Office Action for 2008800007643, Jan. 22, 2010, Panasonic Corporation.

Supplementary European Search Report for Application No. EP 08 79 0364, Oct. 12, 2010, Panasonic Corporation.

Joon-Young Song et al., "Preparation and characterization of CuO doped $Bi_2O_3$-$B_2O_3$-BaO-ZnO glass system for transparent dielectric layer", Journal of Non-Crystalline Solids, North-Holland Physics Publishing, vol. 352, No. 50-51, pp. 5403-5407, Dec. 1, 2006.

Ji-Su Park et al., "Effect of melting temperature and additives on transparency of Bi based Transparent Dielectric Layer in Plasma Display Panel", 2005 International Meeting on Information Display, Digest of Technical Papers, vol. I, First Edition, pp. 1229-1232, Korean Information Display Society, Seoul, Korea, Jul. 2005.

* cited by examiner

PLASMA DISPLAY PANEL HAVING A PLURALITY OF LAYERS CONTAINING CALCIUM OXIDE AND BARIUM OXIDE

THIS APPLICATION IS A U.S. NATIONAL PHASE APPLICATION OF PCT INTERNATIONAL APPLICATION PCT/JP2008/003378.

TECHNICAL FIELD

The present invention relates to a plasma display panel to be used in a display device.

BACKGROUND ART

A plasma display panel (hereinafter referred to simply as a PDP) allows achieving high definition display and a large-size screen, so that television receivers (TV) with a large screen having as great as 100 inches diagonal length can be commercialized by using the PDP. In recent years, use of the PDP in high-definition TV, which needs more than doubled scanning lines than conventional NTSC method, has progressed and the PDP free from lead (Pb) is commercialized in order to contribute to environment protection.

The PDP is basically formed of a front panel and a rear panel. The front panel comprises the following elements:

- a glass substrate made of sodium-borosilicate-based float glass;
- display electrodes, formed of striped transparent electrodes and bus electrodes, formed on a principal surface of the glass substrate,
- a dielectric layer covering the display electrodes and working as a capacitor; and
- a protective layer made of magnesium oxide (MgO) and formed on the dielectric layer.

The rear panel comprises the following elements:

- a glass substrate;
- striped address electrodes formed on a principal surface of the glass substrate,
- a primary dielectric layer covering the address electrodes;
- barrier ribs formed on the primary dielectric layer; and
- phosphor layers formed between the respective barrier ribs and emitting light in red, green, and blue respectively.

The front panel confronts the rear panel such that its surface mounted with the electrodes confronts a surface mounted with the electrodes of the rear panel, and peripheries of both the panels are sealed air-tightly to form a discharge space therebetween, and the discharge space is partitioned by the barrier ribs. The discharge space is filled with discharge gas of Ne and Xe at a pressure ranging from 55 kPa to 80 kPa. The PDP allows displaying a color video through this method: Voltages of video signals are selectively applied to the display electrodes for discharging, thereby producing ultra-violet rays, which excite the respective phosphor layers, so that colors in red, green, and blue are emitted, thereby achieving the display of a color video.

The bus electrodes of the display electrodes employ silver electrodes in order to maintain electrical conductivity, and the dielectric layer employs low-melting glass made of mainly lead oxide. However, in recent years, dielectric layers free from lead for contributing to environment protection have been disclosed in, e.g. patent documents 1, 2, 3, and 4.

However, during the steps of forming the front panel, the silver electrode forming the display electrode diffuses silver ions into the dielectric layer and the glass substrate. The diffused silver ions are subject to the reducing action of alkaline metal ions contained in the dielectric layer and divalent tin ions contained in the glass substrate, thereby forming silver colloid. As a result, the dielectric layer and the glass substrate tend to be yellowed or browned more noisily, and yet, silver oxide having undergone the reducing action generates oxygen which incurs air bubbles in the dielectric layer. The yellowing changes chromaticity, thereby badly degrading picture quality, and what is worse, the air bubbles in the dielectric layer generate failures in insulation of the dielectric layer.

To decrease the yellowing or air bubbles, a double-layer structure is employed to the dielectric layer, namely, the dielectric layer is formed of two layers having different glass compositions. Each one of the two layers is fired during its manufacturing step, so that if air bubbles occur in either one of the layers, the dielectric layer can maintain its electrical withstanding voltage for reducing the failures in insulation.

The respective layers of the dielectric layer have different advantages so that the problems such as the yellowing can be overcome. To be more specific, a lower dielectric layer touching the electrodes of the front panel employs a glass composition which allows reducing the yellowing or air bubbles, and an upper dielectric layer to be formed on the lower dielectric layer employs another glass composition having a higher transmittance.

However, use of multiple dielectric layers differing in materials will complicate the material handling, and eventually increase the cost. On top of that, it invites a misuse of the materials. If the dielectric layer is formed of multiple layers made of only the glass composition employed to the lower dielectric layer, the transmittance of the dielectric layer cannot reach a sufficient level. On the other hand, if the dielectric layer is formed of multiple layers made of only the glass composition employed to the upper dielectric layer, it invites the yellowing and air bubbles.

Patent Document 1: Unexamined Japanese Patent Application Publication No. 2003-128430

Patent Document 2: Unexamined Japanese Patent Application Publication No. 2002-053342

Patent Document 3: Unexamined Japanese Patent Application Publication No. 2001-045877

Patent Document 4: Unexamined Japanese Patent Application Publication No. H09-050769

DISCLOSURE OF INVENTION

A plasma display panel (PDP) of the present invention comprising the following elements:

- a front panel including at least display electrodes and a dielectric layer that are formed on a glass substrate; and
- a rear panel including electrodes, barrier ribs, and phosphor layers that are formed on a substrate, wherein the front panel and the rear panel confront each other, and peripheries thereof are sealed to form a discharge space therebetween, wherein the dielectric layer is formed of multiple layers, and each one of the multiple layers is made of identical material to each other, and the dielectric layer contains calcium oxide (CaO) and barium oxide (BaO), and the content expressed in mole % of CaO is greater than that of BaO.

The foregoing structure allows reducing the yellowing of the PDP, and yet improving a linear transmittance of the dielectric layer. What is more, since the dielectric layer is formed of multiple layers, the PDP with high reliability is obtainable.

| DESCRIPTION OF REFERENCE MARKS | |
|---|---|
| 1 | PDP |
| 2 | front panel |
| 3 | front glass substrate |
| 4 | scan electrode |
| 4a, 5a | transparent electrode |
| 4b, 5b | metal bus electrode |
| 5 | sustain electrode |
| 6 | display electrode |
| 7 | black stripe (lightproof layer) |
| 8 | dielectric layer |
| 8a | lower dielectric layer |
| 8b | upper dielectric layer |
| 9 | protective layer |
| 10 | rear panel |
| 11 | rear glass substrate |
| 12 | address electrode |
| 13 | primary dielectric layer |
| 14 | barrier rib |
| 15 | phosphor layer |
| 16 | discharge space |

PREFERRED EMBODIMENT OF THE INVENTION

The PDP in accordance with an exemplary embodiment of the present invention is demonstrated hereinafter with reference to the accompanying drawings.

Exemplary Embodiment

Figure 1:
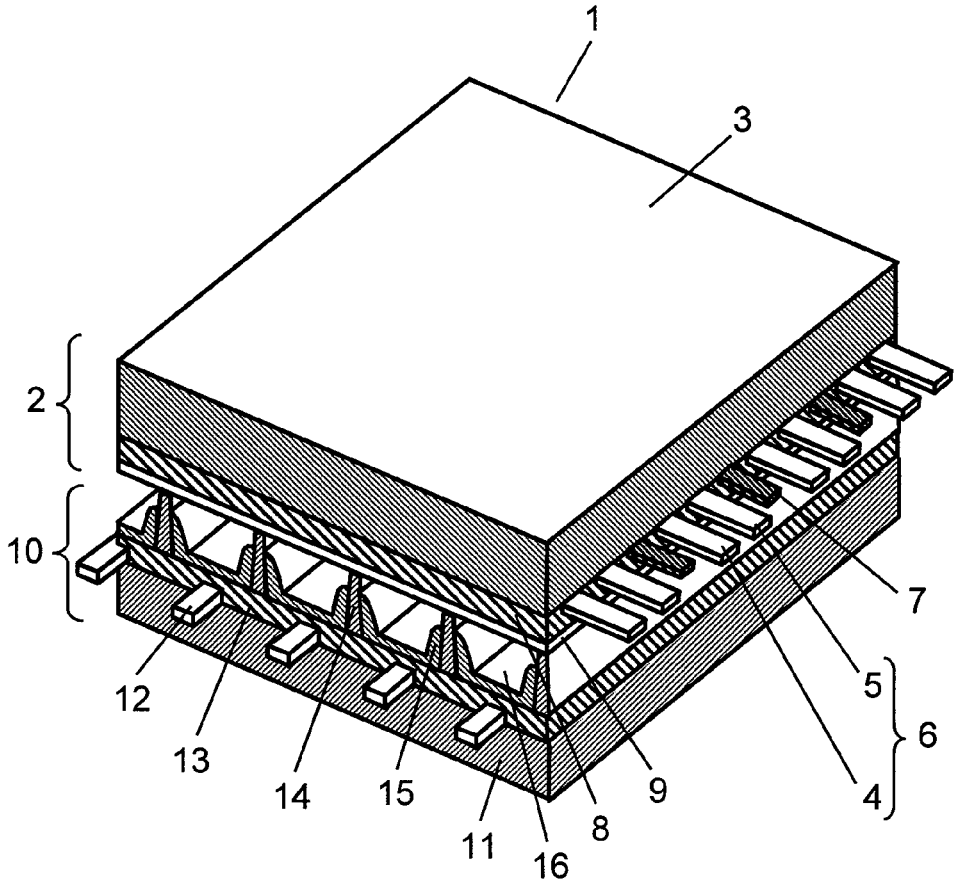
FIG. 1 shows a perspective view illustrating a structure of a PDP in accordance with an exemplary embodiment of the present invention.

FIG. 1 shows a perspective view illustrating a structure of the PDP in accordance with the embodiment of the present invention. The PDP is basically structured similarly to a PDP of AC surface discharge type generally used. As shown in FIG. 1, PDP 1 is formed of front panel 2, which includes front glass substrate 3, and rear panel 10, which includes rear glass substrate 11. Front panel 2 and rear panel 10 confront each other and the peripheries thereof are air-tightly sealed with sealing agent such as glass frit, thereby forming discharge space 16, which is filled with discharge gas of Ne and Xe at a pressure falling in a range between 55 kPa and 80 kPa.

Multiple pairs of belt-like display electrodes 6 formed of scan electrode 4 and sustain electrode 5 are placed in parallel with multiple black stripes (lightproof layer) 7 on front glass substrate 3 of front panel 2. Dielectric layer 8 working as a capacitor is formed on front glass substrate 3 such that layer 8 can cover display electrodes 6 and lightproof layers 7. On top of that, protective layer 9 made of magnesium oxide (MgO) is formed on the surface of dielectric layer 8.

Multiple belt-like address electrodes 12 are placed in parallel with each other on rear glass substrate 11 of rear panel 10, and they are placed along a direction crossing at right angles with scan electrodes 4 and sustain electrodes 5 formed on front panel 2. Primary dielectric layer 13 covers those address electrodes 12. Barrier ribs 14 having a given height are formed on primary dielectric layer 13 between respective address electrodes 12 for partitioning discharge space 16. Phosphor layers 15 are applied, in response to respective address electrodes 12, onto grooves formed between each one of barrier ribs 14. Phosphor layers 15 emit light in red, blue, and green respectively with an ultraviolet ray. A discharge cell is formed at a junction point where scan electrode 14, sustain electrode 15 and address electrode 12 intersect with each other. The discharge cells having phosphor layers 15 of red, blue, and green respectively are placed along display electrodes 6, and these cells work as pixels for color display.

Figure 2:
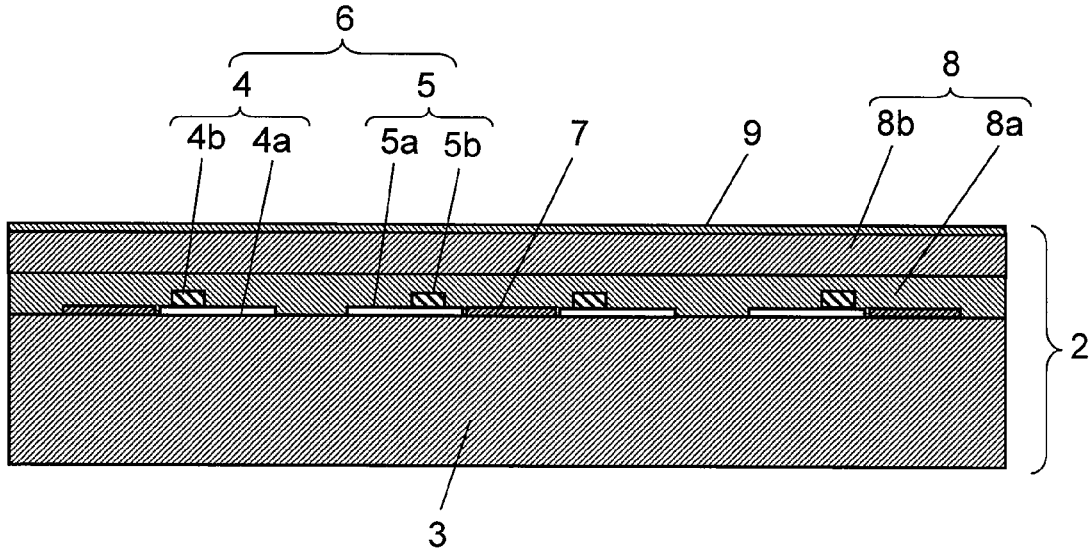
FIG. 2 shows a sectional view illustrating a structure of a front panel of the PDP shown in FIG. 1.

FIG. 2 shows a sectional view illustrating a structure of front panel 2, which includes dielectric layer 8, of PDP 1 in accordance with this embodiment. FIG. 2 shows front panel 2 upside down from that shown in FIG. 1. As shown in FIG. 2, display electrode 6 formed of scan electrode 4 and sustain electrode 5 is patterned on front glass substrate 3 manufactured by the float method. Black stripe 7 is also patterned together with display electrode 6 on substrate 3. Scan electrode 4 and sustain electrode 5 are respectively formed of transparent electrodes 4*a*, 5*a* made of indium tin oxide (ITO) or tin oxide ($SnO_2$), and of transparent electrodes 4*b*, 5*b* employing metal bus electrodes 4*b*, 5*b* formed on electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which main ingredient is silver (Ag).

Dielectric layer 8 formed of upper dielectric layer 8*b* and lower dielectric layer 8*a* that covers transparent electrodes 4*a*, 5*a* and metal bus electrodes 4*b*, 5*b* and black stripes 7 formed on front glass substrate 3. Upper dielectric layer 8*b* is formed on lower dielectric layer 8*a*, and protective layer 9 is formed on dielectric layer 8.

Next, a method of manufacturing PDP 1 is demonstrated hereinafter. First, form scan electrodes 4, sustain electrodes 5, and lightproof layer 7 on front glass substrate 3. Transparent electrodes 4*a*, 5*a* and metal bus electrodes 4*b*, 5*b* are patterned by a photolithography method. Transparent electrodes 4*a*, 5*a* are formed by using a thin-film process, and metal bus electrodes 4*b*, 5*b* are made by firing the paste containing silver (Ag) at a desirable temperature before the paste is hardened. Light proof layer 7 is made by screen-printing the paste containing black pigment, or by forming the black pigment on the entire surface of the glass substrate, and then patterning the pigment with the photolithography method before the paste is fired.

Next, apply dielectric paste onto front glass substrate 3 with a screen printing method such that the paste can cover scan electrodes 4, sustain electrodes 5, and lightproof layer 7, thereby forming a dielectric paste layer. Then leave front glass substrate 3, on which dielectric paste has been applied, for a given time, so that the surface of the dielectric paste is leveled to be flat. Then fire and harden the dielectric paste layer for forming lower dielectric layer 8*a* which covers scan electrodes 4, sustain electrodes 5 and lightproof layer 7. The dielectric paste is a kind of paint containing binder, solvent, and dielectric material such as glass powder.

Then apply the dielectric layer material identical to that of lower dielectric layer 8*a* onto layer 8*a* with a die-coating method different from the method used for forming lower dielectric layer 8*a*. Then leave the applied material for a given time so that the surface of the material is leveled to be flat. Then fire and harden the applied material, thereby forming upper dielectric layer 8*b* on lower dielectric layer 8*a*.

Next, form protective layer 9 made of magnesium oxide (MgO) on upper dielectric layer 8*b* with a vacuum deposition method. The foregoing steps allow forming predetermined structural elements (scan electrodes 4, sustain electrodes 5, lightproof layer 7, dielectric layer 8 and protective layer 9) on front glass substrate 3, so that front panel 2 is completed.

Rear panel 10 is formed this way: First, form a material layer, which is a structural element of address electrode 12, by screen-printing the paste containing silver (Ag) onto rear glass substrate 11, or by patterning with the photolithography method a metal film which is formed in advance on the entire surface of substrate 11. Then fire the material layer at a given temperature, thereby forming address electrode 12. Next, form a dielectric paste layer on rear glass substrate 11, on which address electrodes 12 have been formed, by applying dielectric paste onto substrate 11 with the die-coating method such that the layer can cover address electrodes 12. Then fire the dielectric paste layer for forming primary dielectric layer 13. The dielectric paste is a kind of paint containing binder, solvent, and dielectric material such as glass powder.

Next, apply the paste containing the material for barrier rib onto primary dielectric layer 13, and pattern the paste into a given shape, thereby forming a barrier-rib layer. Then fire this barrier-rib layer for forming barrier ribs 14. The photolithography method or a sand-blasting method can be used for patterning the paste applied onto primary dielectric layer 13. Next, apply the phosphor paste containing phosphor material onto primary dielectric layer 13 surrounded by barrier ribs 14 adjacent to each other and also onto lateral walls of barrier ribs 14. Then fire the phosphor paste for forming phosphor layer 15. The foregoing steps allow completing rear panel 10 including the predetermined structural elements on rear glass substrate 11.

Front panel 2 and rear panel 10 discussed above are placed confronting each other such that scan electrodes 4 cross with address electrodes 12 at right angles, and the peripheries of panel 2 and panel 10 are sealed with glass frit to form discharge space 16 therebetween, which is filled with discharge gas including Ne, Xe. PDP 1 is thus completed.

Next, dielectric layer 8 of front panel 2 is detailed hereinafter. Dielectric layer 8 needs a high dielectric strength, and yet, it needs a high light transmittance. In other words, if lower and upper dielectric layers 8*a* and 8*b* are made of an identical material, the material must have a high light transmittance and capability of reducing both of the yellowing and the air bubbles. These two properties largely depend on the composition of the glass component contained in the dielectric layer.

A conventional way of forming the dielectric layer is this: Paste is applied to front glass substrate 3, on which electrodes have been formed, with the screen-printing method. The paste contains glass powder component and binder component formed of solvent including resin, plasticizer, and dispersant. Front glass substrate 3 is then dried and fired at 450-600° C. for forming the lower dielectric layer. Then another paste is applied onto the lower dielectric layer with the screen printing method or the die-coating method. This another paste contains glass power component, different from that of the lower dielectric layer, and binder component formed of solvent including resin, plasticizer, and dispersant. This paste is then dried, and fired at 450-600° C. for forming the upper dielectric layer. Here is another method of forming the dielectric layer, i.e. the pastes for the lower and upper dielectric layers are applied onto a film, and dried, then transcribed onto the front glass substrate, on which electrodes have been formed, before it is fired at 450-600° C.

The glass component of conventional dielectric layer has contained lead oxide (PbO) more than 20 wt % in order to allow the firing at 450-600° C. However, in recent years, lead-free glass has been available for the purpose of environment protection, and this glass contains bismuth oxide ($Bi_2O_3$) instead of lead oxide, and the content of $Bi_2O_3$ falls in the range from 0.5 to 40 wt %.

PDP 1 in accordance with this embodiment of the present invention includes multiple layers in dielectric layer 8, and each one of the multiple layers is made of identical compositions. Dielectric layer 8 contains CaO and BaO, where the content expressed in mole % of CaO is greater than that of BaO.

Since dielectric layer 8 is formed of multiple layers, the manufacturing steps of each one of the multiple dielectric layers include a firing step, so that a film thickness of respective layers can be thinner. If air bubbles occur from residual organic component of display electrodes 6 and the like during the firing step of lower dielectric layer 8*a*, the air bubbles tend to burst on the surface of layer 8*a*. On top of that, upper dielectric layer 8*b* is formed on the surface, thereby compensating the voids of the burst air bubbles, so that dielectric layer 8 becomes stronger in dielectric strength. As a result, the higher reliability can be expected. Since the multiple layers are made of the identical compositions, losses both in handling materials and the cost can be reduced.

The manufacturing method and the materials of dielectric layer 8 are detailed hereinafter. The glass material having a given composition is grinded by a wet jet mill or a ball mill into powder of which average particle diameter is 0.5 μm-3.0 μm. This powder is used for forming the dielectric layer. Next, this dielectric powder of 50-65 wt % and binder component of 35-50 wt % are mixed with a three-roll mill, so that dielectric paste to be used in the die-coating or the printing can be produced.

The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, alkyl-allyl based phosphate for improving the printing performance.

Next, the dielectric paste discussed above is applied to front glass substrate 3 with the screen-printing method such that the paste covers display electrodes 6, before the paste is dried. The paste is then fired at 575-590° C. a little bit higher than the softening point of the dielectric material, thereby forming lower dielectric layer 8*a*. Then the dielectric paste formed of the identical composition to that of layer 8*a* is applied onto layer 8*a* with a different method from the method used for forming layer 8*a*, e.g. a die-coating method. The applied paste is then dried and fired at 575-590° C. a little bit higher than the softening point of the dielectric material, thereby forming upper dielectric layer 8*b*.

A brightness of PDP advantageously increases and a discharge voltage also advantageously lowers at a thinner film thickness of dielectric layer 8, so that the film thickness is desirably set as thin as possible insofar as the dielectric voltage is not lowered. Considering these conditions and a visible light transmittance, the total film thickness of lower and upper dielectric layers 8*a* and 8*b* is set not greater than 41 μm in this embodiment.

The structural materials of dielectric layer 8 in accordance with this embodiment of the present invention are detailed hereinafter. Lower and upper dielectric layers 8*a* and 8*b* contain CaO and BaO, and the content of CaO expressed in mole % is greater than that of BaO.

CaO allows suppressing the reduction of silver ions ($Ag^+$), thereby decreasing the yellowing. CaO works here as an oxidizing agent. The dielectric glass containing CaO unfortunately lowers the visible light transmittance, in particular, the linear transmittance that affects a degree of the definition of display. This embodiment of the present invention thus replaces CaO in parts with BaO which is expected to increase the linear transmittance.

However, BaO accelerates the reduction of the silver ions ($Ag^+$) and incurs the yellowing. It is thus important to add BaO less than the amount of CaO in mole %, so that the addition of BaO can prevent the yellowing with the linear transmittance maintained.

On top of that, since dielectric layer 8 in accordance with this embodiment is formed of multiple layers, i.e. lower dielectric layer 8*a* and upper dielectric layer 8*b*, its liner transmittance is relatively lower than that of layer 8 formed of single layer. However, the contents of CaO and BaO are controlled as discussed above, thereby increasing the reliability with the linear transmittance maintained.

Next, the content of $Bi_2O_3$ and the addition of $R_2O$ are described, where R is selected from the group consisting of Li, Na, and K. In this embodiment, $Bi_2O_3$ is employed as a replacement of lead component in dielectric glass. Increasing the content of $Bi_2O_3$ in the dielectric glass will lower the softening point of the dielectric glass, and this property produces various advantages in the manufacturing process. However, since Bi-based material is expensive, increasing the content of $Bi_2O_3$ will boost the material cost.

On the other hand, decreasing the content of Bi-based material will raise the softening point of the dielectric glass, and the firing thus should be done at a higher temperature, which will prompt the silver electrodes forming the display electrodes to diffuse silver ions in a greater amount. An amount of colloidal silver thus becomes greater, which incurs coloring of the dielectric layer or producing air bubbles, and resultantly degrades the picture quality of the PDP or invites a failure in insulating the dielectric layer.

The present invention focuses on Li, Na, K selected from alkali metals as a replacement of Bi-based material. If the dielectric glass contains some alkali metal oxide, the softening point of the glass lowers, so that the content of Bi-based material can be reduced, and the softening point of the glass is lowered, thereby benefiting the manufacturing process in various ways.

However, if the glass contains too much amount of alkali metal oxide, the reduction of sliver ions, which diffuses from the silver electrodes forming the display electrodes, is accelerated, so that colloidal silver is formed in a greater amount. As a result, coloring of the dielectric layer or the production of air-bubbles occurs, which incurs degradation in picture quality of the PDP or a failure in insulation of the dielectric layer.

In this embodiment, CoO and CuO are added into the dielectric glass in order to suppress the reducing action caused by $R_2O$. On top of that, MoO3 is also added for reducing the production of colloidal Ag. The works of these additives are described hereinafter.

First, the addition of CuO is demonstrated. CuO is reduced to $Cu_2O$ during the firing of dielectric layer 8, thereby suppressing the reducing action of silver ions ($Ag^+$). As a result, yellowing of layer 8 can be suppressed. On the other hand, CuO is found permitting the dielectric glass to color in blue while $Cu_2O$ permits the dielectric glass to color in green, so that the causes of these colorings should be clarified as discussed in the following paragraphs for solving these coloring problems.

The manufacturing of PDP 1 needs multiple firing steps including an assembly step. The reduction of CuO into $Cu_2O$ is subject to the atmospheric condition such as oxygen density during the firing, and it is hard to control a degree of the reduction. These properties of the reduction invite variation in coloring the surface of PDP because much progress in the CuO reduction permits a part of the surface to color in blue rather strongly while less progress in the CuO reduction permits another part of the surface to color in green strongly. This variation in coloring incurs unevenness in brightness as well as in chromaticity, so that the picture quality is degraded.

Thus CoO is added to the dielectric glass in order to suppress the foregoing variation in coloring caused by the reduction of CuO. This CoO also effects coloring the dielectric glass in blue as CuO does; however, the addition of CoO allows the dielectric glass to color in blue more steadily, so that the picture quality of the PDP can be improved.

Optimum amounts of CuO and CoO should be added. The total amount of additives of CuO and CoO preferably falls within a range of 0.03%-03% (mole %). The total amount of 0.03% will produce the foregoing advantage; however, if the total amount exceeds 0.3%, the dielectric glass colors in blue too strongly, so that the picture quality of PDP 1 is degraded contrary to the expectation. If CoO is added solely to the dielectric glass, the reduction of the silver ions ($Ag^+$) cannot be suppressed, and what is worse, the linear transmittance of dielectric layer 8 is lowered. If the total amount of the additives of CuO and CoO is not greater than 0.3 mole %, the dielectric glass colors in blue optimally, so that excellent picture quality of PDP 1 can be expected.

What is more in this embodiment, two or more than two "R"s of $R_2O$ (R is the one selected from Li, Na, K) are contained in dielectric layer 8 because of the following reason: front glass substrate 3 of PDP 1, in general, contains much of $K_2O$ and $Na_2O$, and the firing of dielectric layer 8 at a high temperature, e.g. not lower than 550° C., prompts the $R_2O$ contained in the dielectric glass to exchange alkali metal ions ($Li^+$, $Na^+$, $K^+$) with $Na_2O$ contained in front glass substrate 3, namely, ion-exchange occurs.

Each one of those alkali metal ions ($Li^+$, $Na^+$, $K^+$) affects differently the thermal expansion coefficient of glass substrate 3, so that the ion-exchange occurring during the firing of dielectric layer 8 will make difference in thermally contracted amount between front glass substrate 3 around dielectric layer 8 and the other parts of glass substrate 3. As a result, front glass substrate 3 produces a large warp on its surface at which dielectric layer 8 is formed.

This embodiment of the present invention; however, contains two or more than two $R_2O$ in dielectric layer 8, so that the difference in thermally contracted amount hardly occurs even when the firing produces the ion-exchange, thereby reducing the warp on front glass substrate 3. As a result, not only the amount of $Bi_2O_3$ in mole % can be reduced as little as not greater than 5%, but also the warp of front glass substrate 3 can be reduced.

The oxide to be added as $R_2O$ must include $K_2O$, and preferably includes either one of $Li_2O$ or $Na_2O$, or both of $Li_2O$ and $Na_2O$. The oxide discussed above allows preventing the thermal expansion coefficient of front glass substrate 3 from varying greatly even if the ion-exchange occurs. As a result, a large warp of substrate 3, at which dielectric layer 8 is formed, can be prevented.

A greater content expressed in mole % of $K_2O$ in the dielectric glass than the total content of $Li_2$ and $Na_2O$ in the dielectric glass positively reduces a change in the thermal expansion coefficient of front glass substrate 3, and thus reduces the warp of glass substrate 3.

As discussed above, $R_2O$ indeed allows lowering the softening point of the dielectric glass, but the alkali metal oxide represented by $R_2O$ accelerates the reducing action of silver ions ($Ag^+$) diffused from the silver electrodes forming display electrodes 6. A more amount of colloidal silver is thus produced, which incurs coloring of dielectric layer 8 as well as production of air bubbles in layer 8. As a result, the picture quality of PDP 1 is degraded, or a failure in insulating dielectric layer 8 occurs.

Next, an addition of $MoO_3$, which suppresses the production of colloidal silver as discussed previously, is described hereinafter. The addition of $MoO_3$ to the dielectric glass containing $Bi_2O_3$ tends to produce a stable chemical compound, such as $Ag_2MoO_4$, $Ag_2Mo_2O_7$, or $Ag_2Mo_4O_{13}$, at a temperature as low as not higher than 580° C.

In this embodiment, since dielectric layer 8 is fired at a temperature ranging from 550 to 590° C., the silver ions ($Ag^+$) diffused into layer 8 during the firing reacts with $MoO_3$ in layer 8, thereby producing a stable compound, and thus the silver ions become stable. In other words, the silver ions ($Ag^+$) are stabilized without the reduction thereof, so that no cohering colloidal silver is produced. Oxygen production associated with the production of colloidal silver thus becomes small, so that only a small amount of air-bubbles is produced in dielectric layer 8. $MoO_3$ can be replaced with $WoO_3$, $CeO_2$, or $MnO_2$ which is added instead while the advantage similar to what is discussed above can be maintained.

A content expressed in mole % of $MoO_3$ preferably falls within a range from not lower than 0.1 to not greater than 2%. The content of over 0.1% allows reducing the number of air-bubbles and improving the yellowing; however, the content of over 2% will crystallize the dielectric glass during the firing thereof. As a result, the dielectric glass becomes cloudy and cannot maintain its transparence, and the visible light transmittance thus lowers, which degrades the picture quality of the PDP. The content of less than 2%, on the other hand, makes the dielectric glass resist being crystallized, so that no degradation in the picture quality is expected.

The foregoing composition of dielectric layer 8 of PDP 1 in accordance with the embodiment allows suppressing the yellowing as well as air-bubble production even when dielectric layer 8 touches metal bus electrodes 4*b*, 5*b* made of silver (Ag), and yet the foregoing structure allows the dielectric glass to achieve a high light transmittance as well as to be colored uniformly, and what is more, the structure allows suppressing the warp of the front glass substrate. As a result, dielectric layer 8 formed of multiple layers made of the identical materials allows reducing the air bubbles as well as the yellowing, and inexpensive PDP 1 of high light transmittance and having little yellowing and few air-bubbles is thus achievable.

EXAMPLES

PDP 1 in accordance with the embodiment is produced for evaluating the performance. PDP 1 includes discharge cells, having the following physical dimensions, to be adaptable to a 42-inch high-definition TV.

height of barrier rib 14: 0.15 mm interval between barrier ribs 14 (cell pitch): 0.15 mm interval between display electrodes 6: 0.06 mm The foregoing discharge cell is filled with Ne—Xe based mixed gas in which Xe gas is contained at 15 volume-content % under the pressure of 60 kPa.

The dielectric glass having the material composition shown in table 1 is produced, and lower and upper dielectric layers 8*a* and 8*b* formed of this material composition are produced through different processes from each other. PDP 1 discussed above is formed of dielectric layer 8 including those lower and upper dielectric layers 8*a* and 8*b*.

TABLE 1

| | | Experiment 1 | | | | Comp. 3 | |
|---|---|---|---|---|---|---|---|
| | film thickness | Lower layer 10 μm | Upper layer 30 μm | Comp 1 40 μm | Comp. 2 40 μm | Lower layer 10 μm | Upper layer 30 μm |
| Dielectric layer Glass composition (mole %) | $Bi_2O_3$ | 3.0% | ← | 4.4% | 8.4% | 4.4% | 8.4% |
| | CaO | 3.0% | ← | 20.0% | | 20.0% | |
| | BaO | 1.0% | ← | | 11.7% | | 11.7% |
| | $K_2O$ | 5.0% | ← | | | | |
| | $Na_2O$ | 2.0% | ← | | | | |
| | $Li_2O$ | | | | 2.7% | | 2.7% |
| | CoO | 0.1% | ← | | | | |
| | CuO | 0.2% | ← | | | | |
| | $MoO_3$ | 0.7% | ← | 0.2% | | 0.2% | |
| | Others | 85.0% | ← | 75.4% | 77.2% | 75.4% | 77.2% |

Comp: Comparison

The bottom line of Table 1 shows "Others" which indicate other materials free from lead, such as zinc oxide (ZnO), boron oxide ($B_2O_3$), silicon dioxide ($SiO_2$), aluminum oxide ($Al_2O$), and they are not specified their contents, which though fall within the range specified by conventional art.

Comparison sample 1 is a conventional dielectric layer formed of conventional dielectric glass composition, namely, the materials free from BaO, $K_2O$, $Na_2O$, CoO, and CuO. Lower and upper dielectric layers 8*a* and 8*b* are produced in different processes from each other as samples. Comparison sample 2 is a conventional dielectric layer formed of conventional dielectric glass composition, namely, the materials free from CaO, $K_2O$, $Na_2O$, CoO, CuO, and $MoO_3$. Lower and upper dielectric layers 8*a* and 8*b* are produced in different processes from each other as samples. Comparison samples 1 and 2 include lower and upper dielectric layers 8*a* and 8*b* respectively, and the glass compositions of those layers are identical to each other, and the film thickness of those layers are the same as that used in the experiment 1. Comparison sample 3 includes lower and upper dielectric layers 8*a* and 8*b* formed of different material compositions from each other, and made by different manufacturing methods.

The following items are tested for evaluating the characteristics of the PDPs formed of the dielectric glasses shown in table 1. Table 2 shows the test result.

TABLE 2

| | Experiment 1 | Comparison 1 | Comparison 2 | Comparison 3 |
|---|---|---|---|---|
| Linear transmittance % | 72.8 | 64.3 | 73.2 | 71.1 |
| Yellowing (b*) average | 1.8 | 2.1 | 3.2 | 2.2 |
| Max. | 2.1 | 2.7 | 3.8 | 2.6 |
| Wavelength dependence % | 1.7 | 0.8 | 0.9 | 0.8 |
| Residual stress (MPa) | −0.6 | −0.6 | 1.4 | 0.8 |

TABLE 2-continued

| | Experiment 1 | Comparison 1 | Comparison 2 | Comparison 3 |
|---|---|---|---|---|
| Failures in dielectric voltage test | 0 | 5 | 10 | 2 |

First, the transmittance of front panel 2 is measured with a Haze Meter. The measurement results are deducted other factors, e.g. the transmittance of front glass substrate 3 and scan electrodes 4, then the actual results are used as the transmittance of dielectric layer 8. The linear component of this practical transmittance, i.e. the linear transmittance, is used for the comparison. The linear transmittance of PDP 1 is preferably over 70%, and less than 70% is not preferable because it will lower the brightness of PDP 1.

A degree of yellowing is measured with a colorimeter (made by Konica-Minolta Inc. Model No. CR-300) for obtaining b* values at nine points in the surface of PDP. The average and the maximum value of the b* values are used for the comparisons. The comparison result is also shown in table 2. The b* value indicates how much the yellowing affects the display performance of PDP 1, and the threshold is b*=3. The yellowing becomes more conspicuous at a greater value of b*, and the color temperature lowers accordingly, which is not favorable to PDP 1.

Next, the transmittance of front panel 2 is measured with a spectrophotometric colormetry meter (made by Konica-Minolta Inc. Model No. CM-3600) in order to evaluate a degree of pigmentation of dielectric layer 8. The measurement results are deducted other factors such as the transmittance of front glass substrate 3 and scan electrodes 4, then the actual results are used as the transmittance of dielectric layer 8. On top of that, a transmittance at wavelength of 550 nm is deducted a transmittance at wavelength of 660 nm, and this deduction result is used for the comparisons as a wavelength dependence. The wavelength dependence of PDP 1 is preferably not greater than 2%, and if it exceeds 2%, a degree of whiteness of the front panel will lower, which is not favorable to PDP 1.

The substrate is measured residual stress with a polariscope in order to evaluate a warp thereof due to the presence of the dielectric glass. The polariscope can measure the residual stress in front glass substrate 3 due to distortion caused by the glass component. The measured residual stress is expressed in table 2 with a plus symbol (+) when compression stress exists in front glass substrate 3, and with a minus symbol (−) when tensile stress exists in substrate 3. The PDP preferably has residual stress expressed with the minus symbol (−) because if it has plus (+) residual stress, then the tensile stress occurs in dielectric layer 8, so that the strength of layer 8 lowers.

A voltage is applied to display electrodes 6 of PDP 1 to test the dielectric voltage of dielectric layer 8, and then the number of layers 8 that have encountered dielectric-breakdown is counted. Table 2 shows the number of defectives in the dielectric voltage test out of 100 samples of PDP 1 which include dielectric layer 8 formed of the dielectric glasses shown in table 1 and have undergone the dielectric voltage test.

According to the result shown in table 2, the comparisons can be concluded as follows: Comparison sample 1 does not reach linear transmittance of 70% because it contains no BaO. Comparison sample 2 shows a high value of b* because it contains no CaO, CuO, or CoO, so that strong yellowing can be expected. Both of comparison samples 1 and 2 show great residual stress because they contain no $K_2O$. Although comparison sample 3 is excellent in the transmittance and the yellowing, it fails in lowering the cost because lower dielectric layer 8*a* is formed of different material from that of upper dielectric layer 8*b*. The dielectric breakdown is found in comparison samples 1, 2 and 3 respectively. On the other hand, PDP 1 in accordance with experiment 1 is excellent in every test, i.e. linear transmittance, yellowing, wavelength dependence, residual stress, and dielectric voltage.

Next, dielectric layers 8 formed of single layer are produced, and each single layer is made of different dielectric glass composition and has a thickness of approx. 40 μm. PDPs 1 including the foregoing dielectric layer 8 are produced in order to test how much the glass composition affects the performances of PDP 1, e.g. transmittance, yellowing, wavelength dependence of the transmittance, and warp of the substrate. Tables 3 and 4 show the test results.

TABLE 3

| Glass Composition (mole %) | Comp. 4 | Comp. 5 | Comp. 6 | Comp. 7 | Comp. 8 | Comp. 9 | Comp. 10 | Comp. 11 | Comp. 12 | Comp. 13 | Comp. 14 |
|---|---|---|---|---|---|---|---|---|---|---|---|
| $Bi_2O_3$ | 3.0% | 3.0% | 3.0% | 3.0% | 3.0% | 3.0% | 3.0% | 3.0% | 3.0% | 3.0% | 3.0% |
| CaO | 3.0% | 3.0% | 4.0% | 2.0% | 1.0% | 3.0% | 3.0% | 3.0% | 3.0% | 3.0% | 3.0% |
| BaO | 1.0% | 1.0% | — | 20% | 3.0% | 1.0% | 1.0% | 1.0% | 1.0% | 1.0% | 1.0% |
| $K_2O$ | 5.0% | 5.0% | 7.0% | 5.0% | 5.0% | 5.0% | — | 2.0% | 5.0% | 5.0% | 5.0% |
| $Na_2O$ | 2.0% | 2.0% | — | 2.0% | 2.0% | 2.0% | 2.0% | 4.0% | 2.0% | 2.0% | 2.0% |
| $Li_2O$ | — | — | — | — | — | — | 5.0% | 1.0% | — | — | — |
| CoO | 0.1% | 0.1% | — | — | — | 0.2% | 0.1% | 0.1% | 0.1% | 0.2% | — |
| CuO | 0.1% | 0.2% | 0.3% | 0.3% | 0.3% | 0.3% | 0.2% | 0.2% | 0.2% | — | — |
| $MoO_3$ | 0.7% | 0.7% | 0.7% | 0.7% | 0.7% | 0.7% | 0.7% | 0.7% | 2.5% | 0.7 | 0.7% |
| Others | 85.1% | 85.0% | 85.0% | 85.0% | 85.0% | 84.8% | 85.0% | 85.0% | 83.2% | 85.1% | 85.3% |

Comp: Comparison

TABLE 4

| | | Comp. 4 | Comp. 5 | Comp. 6 | Comp. 7 | Comp. 8 | Comp. 9 | Comp. 10 | Comp. 11 | Comp. 12 | Comp. 13 | Comp. 14 |
|---|---|---|---|---|---|---|---|---|---|---|---|---|
| Linear transmission (%) | | 71.2 | 73.6 | 67.7 | 82.7 | 74.5 | 71.9 | 71.7 | 71.4 | 55.8 | 69.2 | 70.0 |
| yellowing (b * value) | average | 1.8 | 1.7 | 1.8 | 5.6 | 2.6 | 1.8 | 2.1 | 2.0 | 2.0 | 1.9 | 6.2 |
| | Max. | 2.0 | 2.0 | 2.3 | 6.1 | 3.4 | 2.1 | 2.3 | 2.2 | 2.3 | 2.1 | 6.4 |

TABLE 4-continued

| | Comp. 4 | Comp. 5 | Comp. 6 | Comp. 7 | Comp. 8 | Comp. 9 | Comp. 10 | Comp. 11 | Comp. 12 | Comp. 13 | Comp. 14 |
|---|---|---|---|---|---|---|---|---|---|---|---|
| Wavelength dependency (%) | 1.0 | 1.9 | 2.1 | 1.7 | 1.8 | 3.1 | 1.4 | 1.5 | 1.3 | 1.1 | 0.9 |
| Residual stress (MPa) | −0.8 | −0.7 | −1.0 | −0.4 | −0.6 | −0.7 | 3.4 | 1.5 | −0.7 | −0.8 | −0.9 |

Comp: Comparison

The test results of comparison samples 4-14 are described hereinafter with reference to table 4. As shown in table 3, comparison sample 6 contains no BaO, comparison sample 12 contains too much $MoO_3$, and comparison sample 13 contains no CuO. These three comparison samples thus fail in reaching the linear transmittance of 70% as shown in table 4.

Although comparison sample 7 reaches as high as 82.7% in the linear transmittance because it contains much of BaO, it is not favorable due to high b* value 5.6. Comparison sample 8 contains no CaO, so that its average b* value is 2.6 (<3.0); however, the maximum b* value is 3.4 which makes a dispersion greater, and it is not favorable.

Comparison sample 9 contains CoO and CuO in total as much as 0.5%, so that its wavelength dependence of transmission becomes as high as 3.1%. Comparison sample 9 is thus not favorable. Comparison sample 10 and comparison sample 11 are not favorable because their residual stress is marked with (+), for comparison sample 10 contains no $K_2O$, and comparison sample 11 contains $K_2O$ less than the total amount of $Na_2O$ and $Li_2O$. Comparison sample 14 contains no CoO or CuO, so that its b* value becomes high, and thus comparison sample 14 is not favorable.

Comparison samples 4 and 5 obtain excellent result as shown in table 4 because their dielectric glass compositions fall in the range of the dielectric glass composition forming dielectric layer 8 of PDP 1 in accordance with the exemplary embodiment. The dielectric glass composition in accordance with the exemplary embodiment of the present invention thus proves that dielectric layer 8 having a high visible light linear transmittance with less yellowing, being free from lead and easy on the environment is achievable. On top of that, this dielectric layer 8 can prevent the substrate from warping.

Next, the dependence of the yellowing on the content of $Bi_2O_3$ and $R_2O$ is studied with reference to table 5.

TABLE 5

| | Comparison 15 | Comparison 16 | Comparison 17 | Comparison 18 | Comparison 19 |
|---|---|---|---|---|---|
| $Bi_2O_3$ contained in dielectric layer (mole %) | 3.1% | 1.0% | 3.7 | 0% | 5.2% |
| $R_2O$ Contained in dielectric layer (mole %) | 8.6% | 7.8% | 4.0% | 9.3% | 0% |
| Yellowing (b* value) Average value | 1.8 | 2.7 | 1.2 | 5.1 | 7.0 |

PDPs 1 including dielectric layers 8, of which dielectric glass compositions are different from each other, are produced as comparison samples in order to study how much the glass composition affects the performance of PDPs 1. Table 5 shows the compositions and the results. The compositions shown in table 5 include $Bi_2O_3$, $R_2O$ and "Others" shown in table 1, and the contents of only these three items are varied while the other compositions than these three items stay the same.

Comparison samples 15-17 shown in table 5 are formed of the compositions falling within the range in accordance with that of the exemplary embodiment, and those of comparison samples 18 and 19 fall out of the range.

As table 5 tells, comparison sample 18 contains no $Bi_2O_3$ but much of $R_2O$, so that its b* value becomes as high as 5.1, and comparison sample 19 contains some $Bi_2O_3$ but no $R_2O$, so that its b* value becomes as great as 7.0. On the other hand, comparison samples 15-17 contain $Bi_2O_3$ and $R_2O$ in accordance with the exemplary embodiment, so that they obtain excellent results. The inventors have studied a lower limit of the content of $R_2O$, and found that the content of at least 1% allows lowering the softening point of the dielectric glass while the warp of substrate is suppressed.

As discussed above, use of the foregoing dielectric layer 8 formed of multiple layers made of identical material compositions allows PDP 1 in accordance with this embodiment to reduce the yellowing as well as the production of air-bubbles, and yet, to maintain a high light transmittance and uniform coloring in the dielectric glass, and on top of that, the use of this dielectric layer 8 allows preventing front glass substrate 3 from warping.

INDUSTRIAL APPLICABILITY

The PDP of the present invention is free from yellowing in the dielectric layer and free from warp on the glass substrate, and easy on the environment, and yet, it is excellent in display quality. This PDP is obtainable without increasing the cost, so that it is useful as a display device of a large-size screen.

The invention claimed is:

1. A plasma display panel (PDP) comprising:

a front panel including at least display electrodes, and a dielectric layer that are formed on a substrate; and a rear panel including electrodes, barrier ribs, and phosphor layers that are formed on a substrate, wherein the front panel and the rear panel confront each other, and peripheries thereof are sealed to form a discharge space therebetween, wherein the dielectric layer is formed of a plurality of layers made of identical material, wherein each one of the plurality of layers contains CaO, BaO, $K_2O$, $Li_2O$ and $Na_2O$, has a content of CaO is greater than that of BaO, and has a content of $K_2O$ greater than a total content of $Li_2O$ and $Na_2O$.

2. The PDP of claim 1, wherein the dielectric layer contains CoO, CuO, and $Bi_2O_3$.

3. The PDP of claim 2, wherein a total content of CuO and CoO amounts to not greater than 0.3%.

4. The PDP of claim 2, wherein the dielectric layer contains $MoO_3$, and a content of $MoO_3$ is not greater than 2%.

5. The PDP of claim 2, wherein a content of $Bi_2O_3$ is not greater than 5%.

* * * * *